US005744026A

United States Patent [19]

Zoeller

[11] Patent Number: 5,744,026

[45] Date of Patent: Apr. 28, 1998

[54] CATALYST SYSTEM AND PROCESS FOR BENZYL ETHER FRAGMENTATION AND COAL LIQUEFACTION

[75] Inventor: Joseph Robert Zoeller, Kingsport, Tenn.

[73] Assignee: Eastman Chemical Company, Kingsport, Tenn.

[21] Appl. No.: 827,668

[22] Filed: Apr. 10, 1997

[51] Int. Cl.[6] ..... C10G 1/00

[52] U.S. Cl. ..... 208/430; 568/426; 585/469

[58] Field of Search ..... 568/659, 426; 585/469; 208/403, 430, 437

[56] References Cited

PUBLICATIONS

N. Ikenaga, et al., "Hydrogen–Transfer Reaction of Coal Model Compounds in Tetralin with Dispersed Catalysts," Energy & Fuels, 8 (4). pp. 947–952 (1994).

C. Yokokawa, et al., "Studies on the Catalysts for Coal Liquefaction," Nenryo Kyokaishi, 70 (10), pp. 978–984 (1991) (Abstract).

R. C. Cookson and S. R. Wallis, "Pyrolysis of Allyl Ethers. Unimolecular Fragmentation to Propenes and Carbonyl Compounds," J. Chem. Soc. (B), 1966, pp. 1245–1256.

P. DeChamplain, et al., "Flash Thermolysis: Multiple Sigmatropic Rearrangements in *Ortho*–Substituted Aromatic Compounds", Can. J. Chem., vol. 54, 3749–56 (1976).

Badr et al., "Molecular Rearrangements: Part IX –Thermolysis of Dibenzyl Ether" Indian J. Chem., vol. 15B, pp. 242–244 (1977).

R. P. Warzinski & B. C. Bockrath, "Molybdenum Hexacarbonyl as a Catalyst Precursor for Solvent–Free Direct Coal Liquefaction," Energy & Fuels, vol. 10, No. 3, pp. 612–622 (1996).

*Primary Examiner*—C. Warren Ivy
*Assistant Examiner*—Jean F. Vollano
*Attorney, Agent, or Firm*—Michael J. Blake; Harry J. Gwinnell

[57] ABSTRACT

Dibenzyl ether can be readily cleaved to form primarily benzaldehyde and toluene as products, along with minor amounts of bibenzyl and benzyl benzoate, in the presence of a catalyst system comprising a Group 6 metal, preferably molybdenum, a salt, and an organic halide. Although useful synthetically for the cleavage of benzyl ethers, this cleavage also represents a key model reaction for the liquefaction of coal; thus this catalyst system and process should be useful in coal liquefaction with the advantage of operating at significantly lower temperatures and pressures.

19 Claims, No Drawings

CATALYST SYSTEM AND PROCESS FOR BENZYL ETHER FRAGMENTATION AND COAL LIQUEFACTION

This invention was made with United States Government support under contract No. DE-AC22-94PC94065 awarded by the Department of Energy. The Government has certain rights in this invention.

The present invention is a catalyst system and process for benzyl ether fragmentation and coal liquefaction. The catalyst system of the present invention comprises a Group 6 metal, a salt, and an organic halide. The process of the present invention comprises contacting a benzyl ether with the catalyst system of the present invention at a temperature of about 100° C. to 350° C. and pressure of about 1 to 200 atm. The catalyst system and process of the present invention may also be employed for coal liquefaction.

BACKGROUND OF THE INVENTION

Benzyl ethers have long served as models for the liquefaction of coal since that ether link represents one of the key bonds that must be broken when fragmenting the coal polymer. If properly controlled, this reaction may serve as a source of benzaldehydes. See, for example, Cookson, R. C. and Wallis, S. R., "Pyrolysis of Allyl Ethers. Unimolecular Fragmentation to Propenes and Carbonyl Compounds," J. Chem. Soc. (B), 1966, pp 1245–56; and DeChamplain, P. et al., "Flash Thermolysis: multiple signatropic rearrangements in ortho-substituted aromatic compounds," Can. J. Chem., Vol. 54, 3749–56 (1976). Unfortunately, these reactions have generally required very high temperatures and/or protracted reaction times.

I have now found that benzyl ether fragmentation can be conducted under mild conditions by using a catalyst system composed of a Group 6 metal compound, preferably molybdenum, and more preferably molybdenum carbonyl, a salt, and an organic halide. Using dibenzyl ether in the presence of this catalyst system, the selectivity to benzaldehyde and toluene is increased and the reaction occurs at 160°–175° C. in a matter of hours. By contrast, earlier work employed temperatures of about 300° C. for several days; achieving a more rapid reaction required temperatures approaching 900° C.

As stated above, the benzyl ether linkage has been used a model for coal liquefaction for some time. It has also been known for over thirty years that thermally fragmenting dibenzyl ether, generates toluene, benzaldehyde, bibenzyl ($PhCH_2CH_2Ph$), and, in some cases, 1,2-diphenylethanol and/or stilbene. See, for example, Badr et al., "Molecular Rearrangements: Part IX—Thermolysis of Dibenzyl Ether" *Indian J. Chem.*, Vol. 15B, pp 242–44 (1977). However, these processes require very high temperatures and/or extended reaction times to accomplish the fragmentation. The reaction temperatures required to fragment the benzyl ether link may be dramatically reduced to about 160°–175° C. and reaction times shortened compared to the earlier processes by applying a catalyst system composed of a chromium group metal compound, most preferably $Mo(CO)_6$, a salt, and an organic halide.

Since benzyl ether fragmentation serves as a model for the liquefaction of coal, the present catalyst should also serve to lower temperatures and accelerate reaction rates for coal liquefaction to the products oil, asphaltene and preasphaltene. $Mo(CO)_6$, alone or in combination with sulfur, has been used as a catalyst in coal liquefaction. See, for example, Warzinski, R. P. & Bockrath, B. C. "Molybdenum Hexacarbonyl as a Catalyst Precursor for Solvent-Free Direct Coal Liquefaction," *Energy & Fuels*, Vol. 10, No. 3, pp 612–22 (1996). In addition, $Mo(CO)_6$ has even been used as a catalyst for cleaving dibenzyl ether models. See, for example, Ikenega, N. et al., "Hydrogen-Transfer Reaction of Coal Model Compounds in Tetralin with Dispersed Catalysts," *Energy Fuels*, 8 (4), pp 947–52 (1954); and Yokokawa C. et al., "Studies on the Catalysts for Coal Liquefaction," Nenryo Kyokaishi, 70 (10), pp 978–84 (1991). However, the reaction temperatures were still excessive; the catalyst system of the present invention is expected to substantially reduce these temperatures.

DETAILED DESCRIPTION OF THE INVENTION

As stated above, the present invention comprises a catalyst system and process for benzyl ether fragmentation and coal liquefaction. The catalyst system of the present invention comprises a Group 6 metal, a salt, and an organic halide. Further, the process of the present invention is a process for benzyl ether fragmentation or coal liquefaction which comprises contacting a benzyl ether of the formula

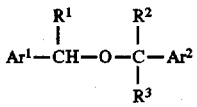

with a catalyst system comprising a Group 6 metal, a salt, and an organic halide wherein $Ar^1$ and $Ar^2$ are the same or different and each is an aromatic group, and $R^1$–$R^3$ are the same or different and each is hydrogen, an aliphatic alkyl group, or an aromatic group. The process is carried out at a pressure of about 1 atm to 200 atm and a temperature of about 100° C. to 350° C.

The present invention further comprises a catalyst system for cleaving a benzyl ether, such as fragmenting or cleaving dibenzyl ether, to benzaldehyde and toluene. Because benzyl ether cleavage serves as a model for coal liquefaction, the process may be used to affect coal liquefaction to oil, asphaltene and preasphaltene. Further, the present invention should be useful for cleaving benzyl ethers as a class of compounds.

In an embodiment of the invention, catalytic quantities of $Mo(CO)_6$, an alkyl halide, and a salt are dissolved in dibenzyl ether and subjected to a pressure of carbon monoxide (34.0 atm) at a temperature of about 160°–175° C. for several hours. Although one may initially expect these conditions to yield benzyl phenylacetate by carbonylation, the major products were found to be toluene and benzaldehyde, along with much smaller amounts of dibenzyl and only small amounts of the expected benzyl phenylacetate.

While the carbon monoxide is very useful for maintaining pressure and to maintain a high selectivity to benzaldehyde and toluene, it is not critical to conducting the reaction, which can proceed in the absence of carbon monoxide. In fact, an additional inert gas such as carbon dioxide or nitrogen may be added to maintain pressure and to maintain the reactants in a liquid state; the inert gases do not otherwise affect the reaction. Hydrogen gas may also be added, alone or in addition to carbon monoxide (as synthesis gas), and has no significant impact on the reaction.

As noted above, the catalyst system of this invention includes a Group 6 metal (Cr, Mo, W), preferably molybdenum. The molybdenum component is more preferably $Mo(CO)_6$, but any of a host of molybdenum species, particularly those with low valence states (−1 to +2) may be used. $Mo(CO)_6$ is the lowest cost, low valent molybdenum species readily available. Other complexes, such as those derived from phosphines, amines, or cyclopentadiene would all be useful. Carbonyl compounds of other Group 6 metals, such as $Cr(CO)_6$ and $W(CO)_6$, are useful, but not as effective as $Mo(CO)_6$.

The organic halide component, may be added as an alkyl halide, the halide being chloride, bromide or iodide. Further, the alkyl halide of the present invention may be an aliphatic or aromatic halide; ethyl halides and benzyl halides are preferred, with benzyl bromide more preferred. Alternatively, it may be generated in situ by adding hydrogen halide to the benzyl ether. The specific choice of halide has a notable effect upon selectivity, with iodides generating higher levels of benzyl phenylacetate than chlorides and bromides. Bromide compounds give the highest conversion rate and highest selectivity to toluene and benzaldehyde, and therefore represent the preferred halide portion of the organic halide catalyst component.

In addition to the organic halide, optimal performance is obtained by adding a salt component that may or may not contain a halide as its anion. An alternative anionic component may be, for example, an acetate; but, a halide anion is preferred. The cationic component of the salt may be selected from a long list of components, which includes alkali metals (e.g., Na, K, or Li) and the Group 15 or 16 elements. Further, the cationic portion may be a quarternary organic compound of Group 15 or 16 with ammonium and phosphonium preferred (e.g., salts of tetraalkyl ammonium or phosphonium), or a trisubstituted organic compound of Group 15 or 16 (again, P or N are preferred). Alternatively, it may be generated in situ by adding an alkyl or hydrogen halide to a free phosphine or amine. Examples of such compounds are tetrabutyl ammonium halide or tetrabutyl phosphonium halide.

In describing the relative proportions of each component, combining any two of the components will induce the fragmentation/liquefaction reaction to a very small degree, but only the combination of the three components gives high conversion and good selectivity to benzaldehyde and toluene (i.e., in the case of dibenzyl ether). Therefore, the molar ratios for the catalyst components (organic halide: salt: Group 6 metal) would fall in the range 0.1–100:0.1–100:1. When the Group 6 component is molybdenum, the concentration of Mo may range from 0.001 to 1 moles/L, with a preferred range of 0.01 to 0.1 moles/L.

The process of the present invention may be carried out at temperatures of about 100° C. to about 350° C. A more preferable range of temperatures is about 150° C. to about 250° C. A still more preferable range, such as those employed in the examples that follow, is about 160° C. to about 175° C.

As for the pressure, there is no requirement for an added gas, such as carbon monoxide. However, there is a notable increase in selectivity and reaction rate upon the addition of carbon monoxide. Hydrogen pressure can be added but we have seen neither an advantage or disadvantage to this addition at present. The process of the present invention may be performed at about 1 to about 200 atm. More preferably, the pressure is about 1 to about 100 atm. Still more preferably, the process is carried out at about 10 to about 50 atm.

The present invention as stated above, is a catalyst system and process for fragmenting benzyl ethers, particularly dibenzyl ether, of the general formula:

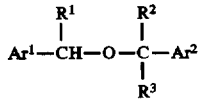

wherein $Ar^1$ and $Ar^2$ are the same or different and each is an aromatic group; and $R^1$–$R^3$ are the same or different and each is hydrogen, an aliphatic alkyl group or an aromatic group. As indicated, an α-hydrogen should be present. The aromatic group in the formula may be polycyclic or heterocyclic and may be optionally substituted or unsubstituted. The benzyl ether link, as noted above, is the key linkage in the coal polymer that researchers seek to break in coal liquefaction. Thus, the present process and catalyst system for fragmenting benzyl ethers, such as dibenzyl ether, should be effective for coal liquefaction.

EXAMPLES

Example 1

To a 300 mL Hastelloy® B autoclave was added 99 g (0.5 mol) of dibenzyl ether ($C_6H_5CH_2OCH_2C_6H_5$), 2.64 g (0.01 mol) of $Mo(CO)_6$, 6.76 g (0.02 mol) of tetrabutylphosphonium bromide, and 3.44 g (0.02 mol) of benzyl bromide. The autoclave was sealed, flushed thoroughly with nitrogen, and pressurized to 10 atm of with carbon monoxide. The autoclave was then heated to 160° C. and, upon reaching temperature, the pressure was adjusted to 20 atm with CO. The autoclave was held at 160° C. and 20 atm for 5 h and then cooled and vented. The anticipated product, benzyl phenylacetate was found to be a minor constituent and GC-MS revealed the major products to be benzaldehyde and toluene, along with minor quantities of bibenzyl ($C_6H_5CH_2CH_2C_6H_5$).

The quantities of toluene, benzaldehyde, bibenzyl, and benzyl phenylacetate were subsequently determined by gas chromatography (GC) analysis using a Hewlett-Packard 5890 Gas Chromatograph with a Hewlett-Packard 7673 Autosampler with a J&W 30M long by 0.25 mm DB-5 column having a film thickness of 0.25μ for the separation and helium as a carrier gas flowing at 1.4 mL/min with an FID detector. Weight gains from CO uptake are negligible and there is no lost weight in the transformation. Therefore, the moles of product can be directly estimated from the GC data by the following equation.

$$\text{Moles} = \frac{\text{Weight fraction (from } GC) \cdot \text{Initial Weight}}{\text{Molecular Weight}}$$

Yields are chemical yields and account for recovered starting material. Since each of the products should represent the consumption of one mole of benzyl ether, these are calculated by the following equation:

$$\text{Yield} = \frac{\text{Moles Product}}{\text{Moles of Dibenzyl Ether Added} - \text{Moles of Dibenzyl Ether Recovered}} \cdot 100\%$$

This method revealed the following levels of material to be present.

| Product | GC Analysis % | Moles | Yield (%) |
|---|---|---|---|
| toluene | 17.7 | 0.215 | 85 |
| benzaldehyde | 18.6 | 0.197 | 78 |
| bibenzyl | 1.4 | 0.008 | 3 |
| benzyl phenylacetate | 1.4 | 0.007 | 3 |
| dibenzyl ether (unreacted) | 43.7 | 0.247 | 51* |

*Conversion

This represents a 51% conversion of dibenzyl ether and represents 21.5 turnovers/Mo and 10.8 turnovers/Br (to toluene.)

Example 2

The reaction in Example 1 was repeated except the reaction was performed at 175° C. and 8.5 g (0.05 mol) of benzyl bromide was used. The conversion was 86% and the results appear below:

| Product | GC Analysis % | Moles | Yield (%) |
|---|---|---|---|
| toluene | 28.1 | 0.356 | 83 |
| benzaldehyde | 29.3 | 0.320 | 75 |
| bibenzyl | 1.1 | 0.007 | 2 |
| benzyl phenylacetate | 2.9 | 0.015 | 3 |
| Unreacted dibenzyl ether | 12.1 | 0.071 | 86* |

*Conversion

Example 3

Example 2 was repeated except that $Cr(CO)_6$ (0.01 mole, 2.20 g) was used in place of $Mo(CO)_6$. The conversion if dibenzyl ether was 15% and the results of the GC analysis appear below:

| Product | GC Analysis % | Moles | Yield (%) |
|---|---|---|---|
| toluene | 4.8 | 0.061 | 81 |
| benzaldehyde | 4.1 | 0.046 | 60 |
| bibenzyl | n.d. | 0 | 0 |
| benzyl phenylacetate | n.d. | 0 | 0 |
| Unreacted dibenzyl ether | 72.1 | 0.424 | 15* |

*Conversion
n.d. = none detected (below detection limit for analytical procedure.)

Example 4

Example 2 was repeated except that $W(CO)_6$ (0.01 mole, 3.52 g) was used in place of $Mo(CO)_6$. The conversion if dibenzyl ether was 31% and the results of the GC analysis appear below:

| Product | GC Analysis % | Moles | Yield (%) |
|---|---|---|---|
| toluene | 11.0 | 0.141 | 91 |
| benzaldehyde | 10.4 | 0.116 | 75 |
| bibenzyl | 0.8 | 0.005 | 3 |
| benzyl phenylacetate | 1.2 | 0.006 | 4 |
| Unreacted dibenzyl ether | 57.9 | 0.345 | 31* |

*Conversion

Examples 3 and 4 demonstrate that the other Cr group (Group 6) metals function, but are inferior to Mo.

Example 5

Example 2 was repeated except that benzyl chloride (0.05 mole, 6.38 g) was used in place of benzyl bromide and tetrabutylphosphonium chloride (0.02 mole, 5.89 g) was used in place of tetrabutylphosphonium bromide. The conversion if dibenzyl ether was 28% and the results of the GC analysis appear below:

| Product | GC Analysis % | Moles | Yield (%) |
|---|---|---|---|
| toluene | 8.5 | 0.106 | 75 |
| benzaldehyde | 9.1 | 0.098 | 70 |

-continued

| Product | GC Analysis % | Moles | Yield (%) |
|---|---|---|---|
| bibenzyl | 1.2 | 0.008 | 5 |
| benzyl phenylacetate | 1.7 | 0.008 | 6 |
| Unreacted dibenzyl ether | 62.2 | 0.359 | 28* |

*Conversion

Example 6

Example 2 was repeated except that ethyl bromide (0.05 mole, 5.40 g) was used in place of benzyl bromide. The conversion if dibenzyl ether was 54% and the results of the GC analysis appear below:

| Product | GC Analysis % | Moles | Yield (%) |
|---|---|---|---|
| toluene | 15.6 | 0.194 | 72 |
| benzaldehyde | 15.7 | 0.169 | 63 |
| bibenzyl | 0.9 | 0.006 | 2 |
| benzyl phenylacetate | 4.1 | 0.021 | 8 |
| Unreacted dibenzyl ether | 40.0 | 0.232 | 54* |

*Conversion

Example 7

Example 2 was repeated except that ethyl iodide (0.05 mole, 7.80 g) was used in place of benzyl bromide. The conversion if dibenzyl ether was 53% and the results of the GC analysis appear below:

| Product | GC Analysis % | Moles | Yield (%) |
|---|---|---|---|
| toluene | 10.5 | 0.136 | 51 |
| benzaldehyde | 10.3 | 0.115 | 43 |
| bibenzyl | 0.9 | 0.006 | 2 |
| benzyl phenylacetate | 10.8 | 0.057 | 21 |
| Unreacted dibenzyl ether | 39.0 | 0.234 | 53* |

*Conversion

Example 8

Example 2 was repeated except that ethyl iodide (0.05 mole, 7.80 g) was used in place of benzyl bromide. The conversion if dibenzyl ether was 36% and the results of the GC analysis appear below:

| Product | GC Analysis % | Moles | Yield (%) |
|---|---|---|---|
| toluene | 2.4 | 0.031 | 17 |
| benzaldehyde | 0.9 | 0.010 | 5 |
| bibenzyl | n.d. | 0 | 0 |
| benzyl phenylacetate | 14.2 | 0.075 | 42 |
| Unreacted dibenzyl ether | 53.2 | 0.320 | 36* |

*Conversion

Example 9

Example 8 was repeated except that 10.2 atm of nitrogen was used in place of CO. The conversion if dibenzyl ether was 33% and the results of the GC analysis appear below:

| Product | GC Analysis % | Moles | Yield (%) |
|---|---|---|---|
| toluene | 7.3 | 0.089 | 54 |
| benzaldehyde | 7.9 | 0.085 | 51 |
| bibenzyl | 1.1 | 0.007 | 4 |
| benzyl phenylacetate | 4.2 | 0.021 | 13 |
| Unreacted dibenzyl ether | 58.7 | 0.335 | 33* |

*Conversion

This example demonstrates that CO is not necessary for the reaction.

Example 10

Example 1 was repeated except that a mixture of 5% hydrogen in CO was used as the feed gas. The conversion if dibenzyl ether was 47% and the results of the GC analysis appear below:

| Product | GC Analysis % | Moles | Yield (%) |
|---|---|---|---|
| toluene | 16.4 | 0.201 | 85 |
| benzaldehyde | 16.9 | 0.180 | 77 |
| bibenzyl | 1.4 | 0.009 | 4 |
| benzyl phenylacetate | 4.5 | 0.022 | 9 |
| Unreacted dibenzyl ether | 46.7 | 0.265 | 47* |

*Conversion

This example demonstrates that hydrogen can be present but does not demonstrably effect the rates.

Example 11

Example 2 was repeated except that tetrabutyl ammonium bromide (0.02 mole, 6.45 g) was used in place of tetrabutyl phosphonium bromide. The conversion if dibenzyl ether was 39% and the results of the GC analysis appear below:

| Product | GC Analysis % | Moles | Yield (%) |
|---|---|---|---|
| toluene | 12.0 | 0.153 | 79 |
| benzaldehyde | 11.3 | 0.125 | 65 |
| bibenzyl | 0.5 | 0.003 | 2 |
| benzyl phenylacetate | 6.2 | 0.032 | 17 |
| Unreacted dibenzyl ether | 51.7 | 0.307 | 39 |

*Conversion

Example 12

Example 2 was repeated except that NaBr (0.02 mole, 2.04 g) was used in place of tetrabutyl phosphonium bromide. The conversion if dibenzyl ether was 100% and the results of the GC analysis appear below:

| Product | GC Analysis % | Moles | Yield (%) |
|---|---|---|---|
| toluene | 15.9 | 0.195 | 39 |
| benzaldehyde | 23.2 | 0.246 | 49 |
| bibenzyl | 8.1 | 0.050 | 10 |
| benzyl phenylacetate | 0.7 | 0.003 | 1 |

-continued

| Product | GC Analysis % | Moles | Yield (%) |
|---|---|---|---|
| Unreacted dibenzyl ether | n.d. | 0 | 100 |

*Conversion
n.d. = none detected

Comparative Example 1

Example 10 was repeated except that $Mo(CO)_6$ was omitted. The conversion if dibenzyl ether was 9% and the results of the GC analysis appear below:

| Product | GC Analysis % | Moles | Yield (%) |
|---|---|---|---|
| toluene | 2.3 | 0.028 | 61 |
| benzaldehyde | 2.5 | 0.025 | 56 |
| bibenzyl | 0 | 0 | 0 |
| benzyl phenylacetate | 0 | 0 | 0 |
| Unreacted dibenzyl ether | 82.4 | 0.454 | 9* |

*Conversion

Comparative Example 2

Example 10 was repeated except that $Bu_4PBr$ was omitted. The conversion if dibenzyl ether was 9% and the results of the CC analysis appear below:

| Product | GC Analysis % | Moles | Yield (%) |
|---|---|---|---|
| toluene | 1.8 | 0.021 | 46 |
| benzaldehyde | 1.9 | 0.019 | 42 |
| bibenzyl | 0 | 0 | 0 |
| benzyl phenylacetate | 0 | 0 | 0 |
| Unreacted dibenzyl ether | 85.8 | 0.455 | 9* |

*Conversion

Comparative Example 3

Example 10 was repeated except benzyl bromide was omitted. The conversion if dibenzyl ether was only 1% and toluene and benzaldehyde were detected at levels below those established for our GC analysis (<1.5%).

The invention has been described in detail with particular reference to preferred embodiments thereof, but it will be understood that variations and modifications can be effected within the spirit and scope of the invention.

I claim:

1. A process for benzyl ether fragmentation or coal liquefaction which comprises contacting a benzyl ether compound or coal, with a catalyst system comprising a Group 6 metal, a halide salt and an organic halide under conditions of temperature and pressure sufficient to cause the fragmentation or liquefaction.

2. A process as claimed in claim 1 wherein the process is carried out at about 1 to 200 atm and at about 100° C. to 350° C.

3. A process as claimed in claim 2 wherein the salt is an alkali metal salt, a salt of a group 15 or 16 element, a salt of a quarternary organic compound of an element of Group 15 or generated from a trisubstituted organic compound of Group 15.

4. A process as claimed in claim 3 wherein the organic halide is an alkyl halide, an aromatic halide or generated from a hydrogen halide.

5. a process as claimed in claim 2 wherein the metal is molybdenum, chromium or tungsten.

6. A process as claimed in claim 5 wherein the metal is $Mo(CO)_6$.

7. A process as claimed in claim 2 wherein the pressure is about 1 to about 100 atm and the temperature is about 150° C. to 250° C.

8. A process as claimed in claim 7 wherein the pressure is about 10 atm to 50 atm and the temperature is about 160° C. to 175° C.

9. A process as claimed in claim 4 wherein the salt is tetrabutyl phosphonium halide, tetrabutyl ammonium halide or an alkali metal halide and the organic halide is a benzyl halide or an ethyl halide.

10. A process for benzyl ether fragmentation or coal liquefaction which comprises contacting a benzyl ether of the formula

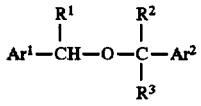

or coal with a catalyst system comprising (1) a molybdenum compound, (2) a salt of a quarternary phosphonium or ammonium or an alkali metal salt, and (3) an alkyl halide or an aromatic halide at a pressure of about 1 to 100 atm and a temperature of about 150° C. to 250° C. to cause the fragmentation or liquefaction, wherein $Ar^1$ and $Ar^2$ are the same or different and each is an aromatic group, and $R^1$–$R^3$ are the same or different and each is a hydrogen or an aliphatic alkyl or aromatic group.

11. A process as claimed in claim 10 wherein the molybdenum compound is $Mo(CO)_6$.

12. A process as claimed in claim 10 wherein the contacting is in the presence of carbon monoxide.

13. A process as claimed in claim 10 wherein component (2) is a halide of a quarternary phosphonium or ammonium and (3) is a benzyl halide or an ethyl halide.

14. A process as claimed in claim 10 wherein the pressure is about 10–50 atm and the temperature is about 160° C. to 175° C.

15. A process as claimed in claim 13 wherein (3) is benzyl bromide.

16. A process as claimed in claim 10 wherein the benzyl ether is dibenzyl ether.

17. A process for fragmenting dibenzyl ether comprising contacting the dibenzyl ether with a catalyst system comprising (1) a molybdenum compound, (2) a salt of a quarternary phosphonium or ammonium or an alkali metal salt, and (3) an alkyl halide or aromatic halide at a pressure of about 1 to 100 atm and a temperature of about 150° C. to 250° C., said contacting being in the presence of carbon monoxide.

18. A process as claimed in claim 17 wherein the molybdenum compound is $Mo(CO)_6$, and (3) is benzyl halide or ethyl halide and the pressure is about 10 to 50 atm and the temperature is about 160° C. to 175° C.

19. A process as claimed in claim 18 wherein (2) is a tetraalkyl ammonium or phosphonium halide and (3) is benzyl bromide.

* * * * *